US007092542B2

(12) United States Patent
McGrath

(10) Patent No.: US 7,092,542 B2
(45) Date of Patent: Aug. 15, 2006

(54) CINEMA AUDIO PROCESSING SYSTEM

(75) Inventor: David Stanley McGrath, Ultimo (AU)

(73) Assignee: Lake Technology Limited, Surry Hills (AU)

( * ) Notice: Subject to any disclaimer, the term of this patent is extended or adjusted under 35 U.S.C. 154(b) by 607 days.

(21) Appl. No.: 09/933,470

(22) Filed: Aug. 15, 2001

(65) Prior Publication Data

US 2002/0048380 A1 Apr. 25, 2002

(51) Int. Cl.
*H04R 5/02* (2006.01)

(52) U.S. Cl. ..... 381/307; 381/19

(58) Field of Classification Search ..... 381/17–23, 381/300, 307, 27

See application file for complete search history.

(56) References Cited

U.S. PATENT DOCUMENTS 5,809,149 A * 9/1998 Cashion et al. ..... 381/17
5,822,438 A * 10/1998 Sekine et al. ..... 381/17
6,026,169 A * 2/2000 Fujimori ..... 381/61
6,125,115 A * 9/2000 Smits ..... 381/17
6,154,549 A * 11/2000 Arnold et al. ..... 381/17
6,363,155 B1 * 3/2002 Horbach ..... 381/17
6,507,658 B1 * 1/2003 Abel et al. ..... 381/17
6,624,873 B1 * 9/2003 Callahan et al. ..... 352/27
6,694,033 B1 * 2/2004 Rimell et al. ..... 381/307

* cited by examiner

*Primary Examiner*—Brian T. Pendleton
(74) *Attorney, Agent, or Firm*—Dov Rosenfeld; Inventek

(57) ABSTRACT

In a multi viewer environment where multiple viewers simultaneously experience an audio-visual production, with the visual production occurring on a display surface, a method of increasing the perceived reality of the audio stream of the production, the method comprising the steps of: (a) locating a series of speakers along a periphery of the viewing audience; (b) panning an audio stream between the series of speakers so as to provide for the sense of an audio sound moving along the side of the viewing audience. In preferred embodiments, the output of one of the speakers is delayed relative to another speaker.

6 Claims, 5 Drawing Sheets

CINEMA AUDIO PROCESSING SYSTEM

FIELD OF THE INVENTION

The present invention relates to the processing of audio for reproduction in a cinema type audience environment.

BACKGROUND OF THE INVENTION

The utilisation of audio reproduction in a cinema type environment is well known in the art. Examples of popular reproduction formats include the Dolby® Digital format and the DTS format.

In the Dolby® Digital format, the cinema track is recorded in a five channel format for reproduction over five speakers. The five channel format includes a front left, front centre and front right channel and a rear left and right channel. The input audio format is designed for reproduction in a cinema type environment where five speakers are placed around an audience. An example of the format is illustrated schematically in FIG. 1 wherein, in a cinema environment 1, two audience members 2A and 2B are placed with five speakers 3–7 being placed around the audience members. The audio track of the movie is then mixed in a five channel format for reproduction in such an environment.

The utilisation of a system such as that in FIG. 1 is thought to provide for enhanced spatialization capabilities of an audio track. The five channel format allows a listener to experience a degree of spatialization due to the "mix" previously encoded. Hence, the audio format of FIG. 1 has become quite popular.

Unfortunately, the arrangement of FIG. 1 has a number of drawbacks. For example, where an audience member 2C is located near to one of the speakers then the speaker source 7 is likely to drown out the other speaker sources. As a result, the spatialization effects will be substantially lost. Further, the degree of spatialization that can be provided to the audience is limited as a result of the limitations of the choice provided by a five track arrangement.

SUMMARY OF THE INVENTION

In accordance with a first aspect of the present invention, there is provided in a multi viewer environment where multiple viewers simultaneously experience an audio-visual production, with the visual production occurring on a display surface, a method of increasing the perceived reality of the audio stream of the production, the method comprising the steps of: (a) locating a series of speakers along a periphery of the viewing audience (b) panning an audio stream between the series of speakers so as to provide for the sense of an audio sound moving along the periphery of the viewing audience.

In a preferred embodiment, the series of speakers comprises an array of at least three speakers located along a side of the viewing audience substantially perpendicular to the viewing surface.

The step (b) further can comprise the step of panning the same audio stream to a series of speakers whilst simultaneously delaying the audio stream transmitted by each speaker by an amount that varies along with the panning gain.

In accordance with a further aspect of the present invention, there is provided in a multi viewer environment where multiple viewers simultaneously experience an audio-visual production, with the visual production occurring on a display surface, a method of increasing the perceived reality of the audio stream of the production, the method comprising the steps of: (a) panning an audio stream between at least two speakers so as to provide for the sense of an audio sound moving along the periphery of the viewing audience (b) whilst panning the audio stream, delaying the output of one of the speakers relative to another speaker.

Preferably, the delay of the output from one of the speakers varies along with the panning gain.

In accordance with a further aspect of the present invention, there is provided a system for increasing the perceived reality of an audio stream in a multi viewer environment where multiple viewers simultaneously experience an audio-visual production, with the visual production occurring on a display surface, the system comprising: a series of speakers located along a periphery of the viewing audience; panning means for panning a sound trajectory between the speakers so as to simulate the effect of a sound trajectory along the side of the audience.

The panning means further preferably can include delay means for delaying the output of one speaker relative to another by an amount that varies with the panning gain.

BRIEF DESCRIPTION OF THE DRAWINGS

Notwithstanding any other forms which may fall within the scope of the present invention, preferred forms of the invention will now be described, by way of example only, with reference to the accompanying drawings in which.

DESCRIPTION OF PREFERRED EMBODIMENTS

Figure 1:
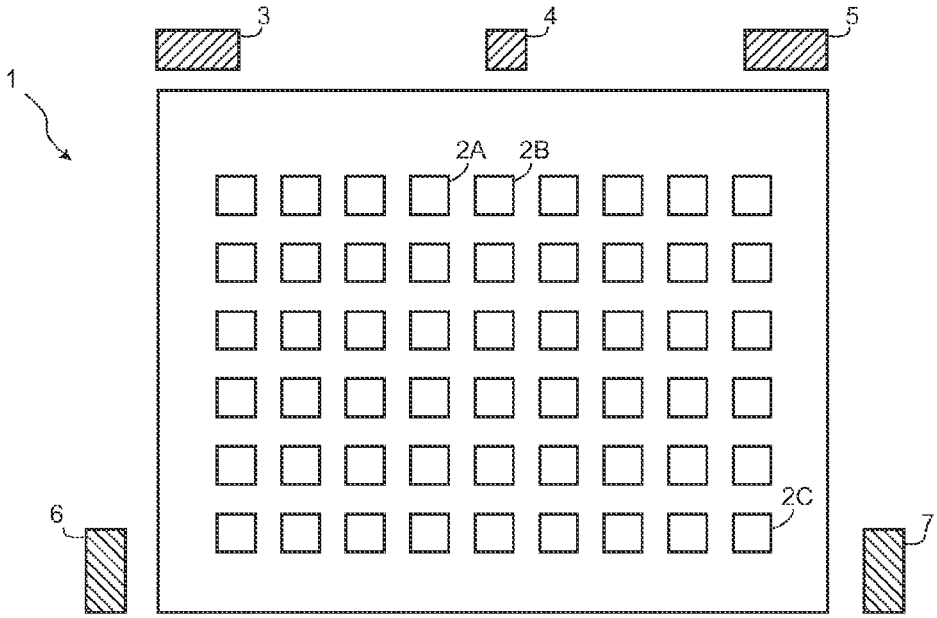
FIG. 1 illustrates schematically a standard cinema speaker arrangement.
Figure 2:
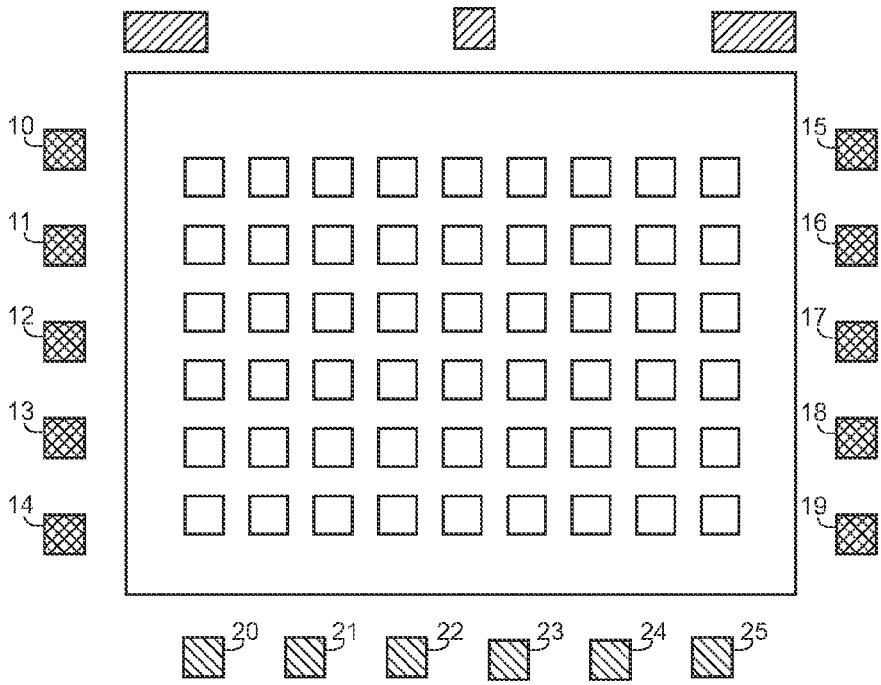
FIG. 2 illustrates one form of a speaker arrangement in accordance with the method of the present invention.

In the preferred embodiment, an alternative audio arrangement is proposed. This alternative arrangement can be as illustrated in FIG. 2 wherein a series of speakers 10 to 19 are placed down each side of the cinema audience. Additionally, a series of speakers 20 to 25 can optionally be placed at the back of the listening audience. The arrangement of FIG. 2 allows for a larger degree of spatialization of audio tracks around a listener whilst maintaining a degree of "coherence" in the sound registering at the ears of each audience member. For example, in the arrangement of FIG. 2, it is possible to pan the sound along the right hand side speakers 15 to 19 to simulate the effect of, for example, an automobile or helicopter passing down the right hand side edge of the listeners. The panning effect can be enhanced through the utilization of delay in addition to amplitude panning. This is especially the case for the simulation of moving sound sources.

Figure 3:
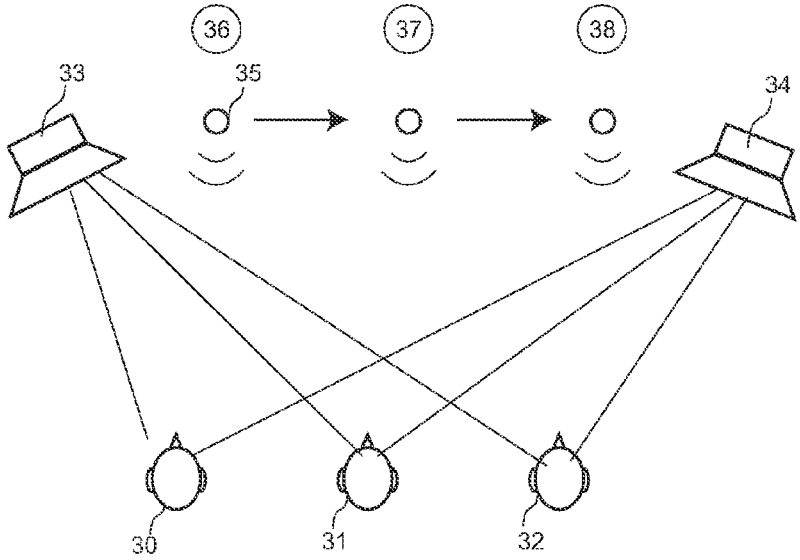
FIG. 3 illustrates the process of panning a sound from one speaker to another so as to simulate an audio trajectory.

For example, turning to FIG. 3, three listeners 30, 31, 32 are seated next to one another. It is desired to simulate a virtual sound 35 which moves from a left speaker 33 to a right speaker 34 at a constant velocity through three intermediate positions 36, 37, 38. A normal technique would be to pan the speaker signal between the two speakers 33 and 34, with the panning being similar to that shown in FIG. 4 with the relative amplitudes emitted by the left and right speakers at times 36, 37 and 38 indicated. However, whilst the panning arrangement of FIG. 4 may work highly effectively for a person 31 located midway between the two speakers, it is often not the case that this arrangement will be as effective for someone 30 located closer to one of the speakers 33 in providing a spatialisation effect Because of the listener's proximity to speaker 33, the output of speaker 33 will sound louder than the output from 34 until later in the panning than for the centrally located listener 31. Furthermore, the listener 30 will always hear the signal from speaker 33 slightly prior to the signal from speaker 34. The resultant effect is that the listener 30 will not experience the same sensation as listener 31 that the virtual sound source has moved closer to speaker 34 or at least with the same smooth trajectory. Listener 32 of course experiences the opposite effect that the virtual source starts at the left speaker but too quickly moves to the right speaker rather than with a steady velocity.

Figure 5:
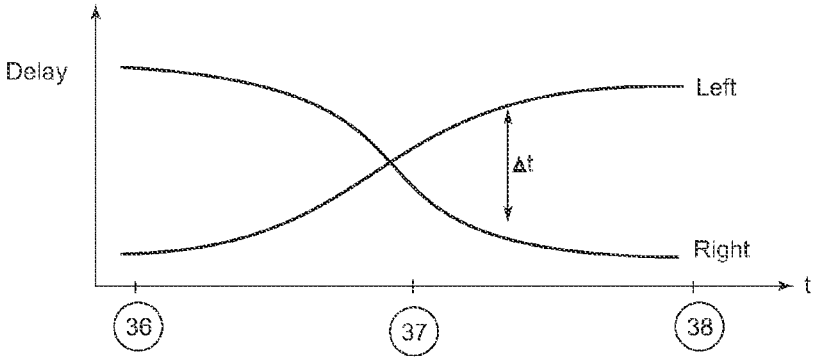
FIG. 5 illustrates the utilization of delay processing in panning signals.

In the preferred embodiment, not only are the speaker signals panned, but the two signals also undergo a varying delay shifting with respect to one another. One example of delay shifting is as illustrated in FIG. 5 which depicts the degree of delay between the left and right channels as the sound source moves from the left to the right point. The degree of delay is created so that two sounds projected from each speaker 33, 34 can better give the effect of apparent movement of the virtual sound source 35 for all audience members, not just those located on centre.

Figure 4:
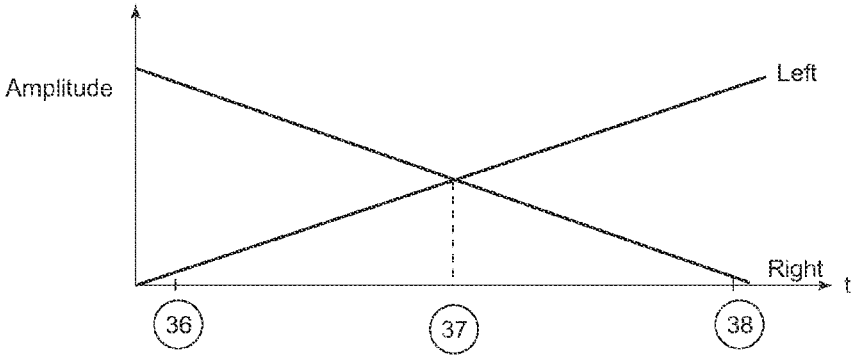
FIG. 4 is a graph of panning magnitudes in panning a sound from a first speaker to a second speaker.

Observing FIGS. 4 and 5 in combination, at a time when the position of the virtual source is at location 36, the sound from left speaker 33 is of greater amplitude and lower delay than for right speaker 34, that is, the signal from speaker 33 is emitted slightly prior to the signal from speaker 34. At this time, the relative delay between speakers 33, 34 may be up to approximately 10 ms. The effect is that each of the listeners 30, 31, 32 will experience the sound emanating predominantly from speaker 33. As time progresses and the virtual source moves from left to right as in FIG. 3, the delay from speaker 33 increases and the amplitude decreases whilst the delay from speaker 34 decreases and the amplitude increases. At the point 37, the amplitudes and delays from each of the speakers are equal. The central listener will thus experience the sensation that the virtual source is centrally located between the speakers. The listener 30 however, being situated closer to the speaker 33, will still experience the sensation that the virtual source 35 is located more left than right whilst the listener 32 will experience the source having already moved through a centre position. As the source 35 progresses through to point 38, the delays from speakers 33, 34 smoothly increase and decrease respectively to the point where the created delay overcomes the inherent delay experienced by listener 30 due to the difference in propagation distances from the speakers 33,34 to the listener 30. Thus listener 30 not only perceives the sound from speaker 34 as louder, but the sound from speaker 34 also arrives simultaneously with or earlier than the sound from speaker 33. The effect is that listener 30 perceives the sound source to have smoothly moved from left to right.

Whilst each listener has received a different apparent audio stream experience due to their different positions relative to the speakers, each listener has nonetheless experienced the sensation of the virtual sound source moving from left to right with a smoother trajectory than if a time delay were not employed.

The shaping of the time delay signals can determine to what extent the spatialisation effects of the audio stream are experienced by the listeners and will depend on case specific factors such as speaker separation, the number of speakers in the array, the speed of the virtual sound source, the proximity of the speakers to audience members and the size of the audience.

Figure 6:
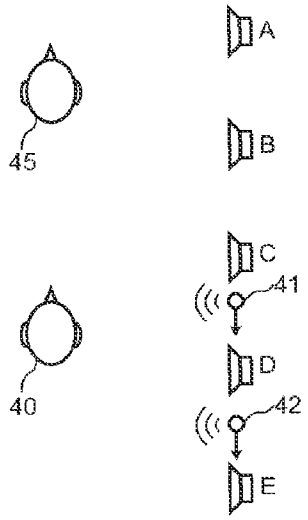
FIG. 6 illustrates a portion of a speaker layout in a cinema environment.

In this manner, an improved sound rendering is provided which allows for an improved listening experience for those located off centre of the arrangement of FIG. 3, thereby providing for a more linear response to moving sound sources. The arrangement discussed in respect of FIG. 3 can be extended to an audience environment and, for example, projecting virtual sounds travelling down the side of the audience. Such an arrangement is illustrated schematically in FIG. 6 wherein a listener 40 listens to a virtual sound source 41 which travels at a constant velocity down their right hand side so that moments later it is at the point 42. The sound source is played over speakers A to E.

Figure 7:
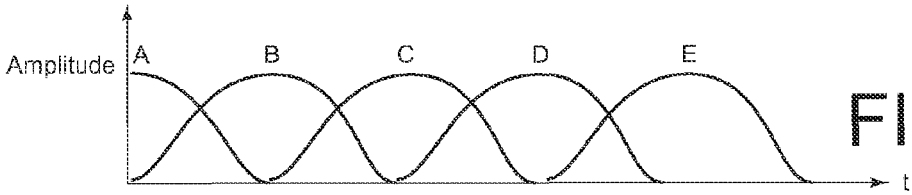
FIGS. 7 to 9 illustrate, respectively, graphs of amplitude, delay and listener delay components in panning signals in the speaker arrangement of FIG. 6.
Figure 8:
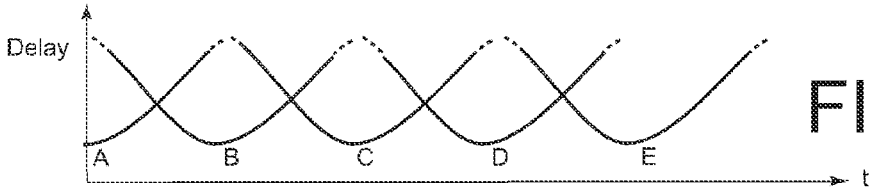
Figure 9:
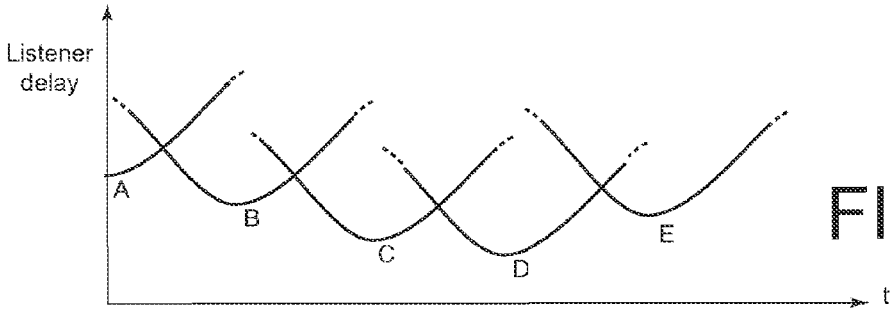

In order to simulate the effect of the moving sound source, the sound is first panned along the speakers as is illustrated in FIG. 7, with the signal to each speaker A–E in turn having its amplitude rise to a maximum and then decay. Similarly, as shown in FIG. 8, the signal to each speaker is delayed depending on a current location of the virtual sound source. The delay can be in accordance with the discussion as mentioned in respect of FIG. 3. In this case, however, it is extended to a multi-speaker arrangement. For the particular listener 40, the approximate overall delay will be similar to that shown in FIG. 9 with the sound appearing to move along the right hand side of the speakers. Speaker A which is located furthest from the listener 40 will have the greatest delay while speaker D which is located adjacent the listener will have the least delay. Importantly, a second listener 45 also hears the sound moving along the series of speakers however with a slightly different delay pattern and timing sequence. A number of different systems incorporating the method of the preferred embodiment are possible.

In a first arrangement, where the speaker arrangement in a cinema is known, the audio track can be totally pre-rendered with custom sets of speaker feeds being created.

Figure 10:
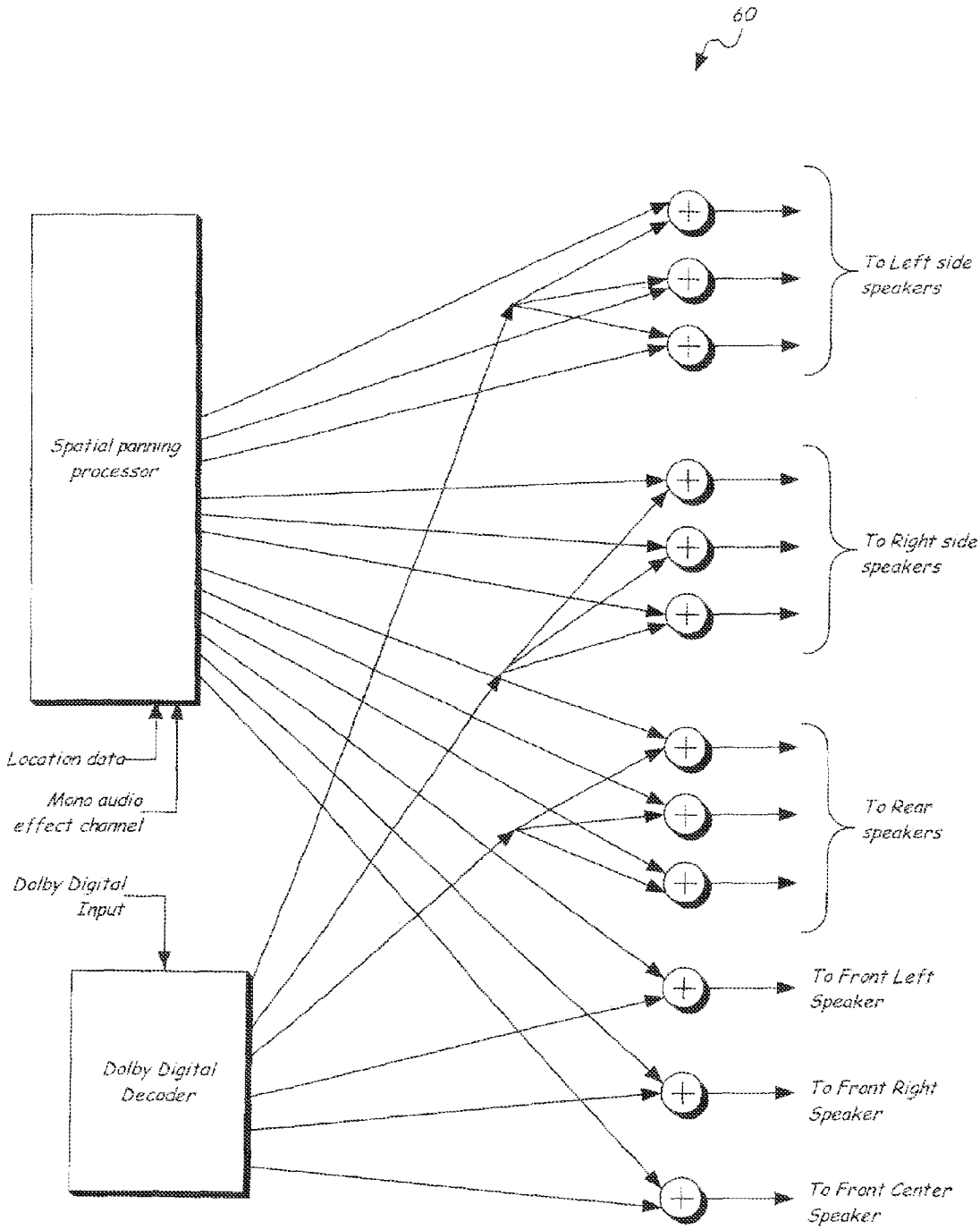
FIG. 10 illustrates schematically a first signal processing embodiment.

In alternative environments, the usual Dolby Digital type speaker feeds might be provided and separate mono channels provided with associated spatial information locating the sound source. The system can then utilise the associated spatial information to render the audio trajectory in the audio output environment. In this embodiment, the spatial information is utilised to pan its corresponding separate mono channel in a sequence across multiple speakers, providing greater spatial resolution than would have been possible if the audio channels had all been pre-mixed into the 5 channel Dolby Digital data (see FIG. 10).

In an alternative environment, where a cinema is not equipped with a separate channel of amplification for each side or rear surround speaker, the system may take the separate mono channels and their associated spatial information, and simply mix the mono channels into the standard speaker signals that connect to the standard cinema sound system. This provides backward compatibility so that this new digital sound format may be employed in cinemas that are not equipped to make use of the added channels.

Figure 11:
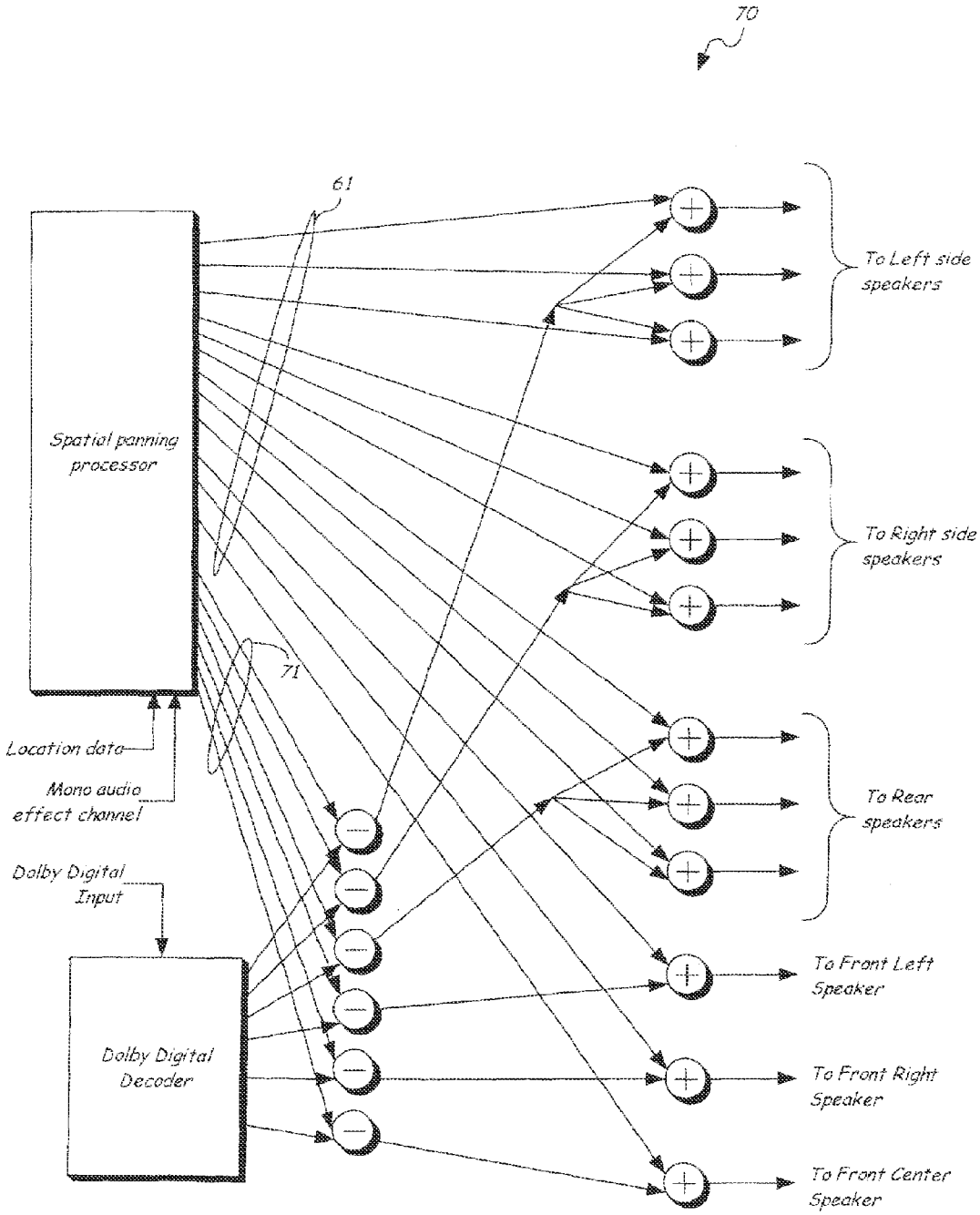
FIG. 11 illustrates schematically a second signal processing embodiment.

In a further improved system with backward compatibility, the original multichannel digital surround audio may already be provided in a form suitable for a standard cinema playback environment, and cinemas with an enhanced playback environment may employ a process whereby the additional separate mono channels and associated spatial information is used to (i) render these separate mono channels to the available speaker system using the panning techniques already described above, and (ii) computing the equivalent panned result of these mono channels in a standard surround configuration, and subtracting said equivalent panned mono channels from the standard surround channels. See FIG. 11.

In a further example system, the ability to manipulate the input Dolby® Digital signals or the like might also be provided. In this example system, the original Dolby® Digital sound track may be analysed to determine when panning sequences are occurring. The panning sequences can then be subtracted out of the Dolby® Digital signal and the system of the invention can be utilised to pan audio around a cinema environment whilst maintaining the Dolby® Digital environment. In this manner, the preferred embodiment provides for an enhanced audio rendering capability.

It would be appreciated by a person skilled in the art that numerous variations and/or modifications may be made to the present invention as shown in the specific embodiments without departing from the spirit or scope of the invention as broadly described. The present embodiments are, therefore, to be considered in all respects to be illustrative and not restrictive.

The invention claimed is:

1. In a multi viewer environment where multiple viewers simultaneously experience an audio-visual production with the visual production occurring on a display surface, a method of increasing the perceived reality of the audio stream of the production, the method comprising the steps of:

(a) locating a plurality of at least three speakers along a periphery of the viewing audience; and (b) panning an audio stream between the series of speakers so as to provide for the sense of an audio sound moving in a front to rear or rear to front direction along the periphery of the viewing audience, wherein step (b) further comprises the step of panning the same audio stream to a set of at least three speakers along the periphery whilst simultaneously delaying the audio stream transmitted to each speaker by an amount that varies along with the panning gain.

2. In a multi viewer environment where multiple viewers simultaneously experience an audio-visual production with the visual production occurring on a display surface, a method of increasing the perceived reality of the audio stream of the production, the method comprising the steps of:

(a) panning an audio stream between at least three speakers so as to provide for the sense of an audio sound moving in a front to rear or rear to front direction along the periphery of the viewing audience, and (b) whilst panning the audio stream, delaying the output of one of the speakers relative to another speaker.

3. A method according to claim 2 wherein the relative delay between the outputs from at least two of the speakers varies along with the panning gain.

4. A method according to claim 2 wherein said audio stream includes a channel containing spatial information, including one of panning gain and delay, for a component of said audio stream to be panned.

5. A system for increasing the perceived reality of an audio stream in a multi viewer environment where multiple viewers simultaneously experience an audio-visual production, with the visual production occurring on a display surface, the system comprising:

a series of at least three speakers located along a periphery of the viewing audience; and panning means for panning a sound trajectory between the speakers so as to simulate the effect of a sound trajectory along the periphery of the audience, wherein said panning means further comprises delay means for delaying the output of at least one speaker relative to another.

6. A system according to claim 5 wherein said delay means varies the delay of said speaker output by an amount that varies with the panning gain.

* * * * *